United States Patent [19]

Snyder

[11] 4,042,444

[45] * Aug. 16, 1977

[54] ETCHANT REJUVENATION CONTROL SYSTEM

[75] Inventor: H. Ben Snyder, Upland, Calif.

[73] Assignee: General Dynamics, Pomona, Calif.

[ * ] Notice: The portion of the term of this patent subsequent to June 22, 1993, has been disclaimed.

[21] Appl. No.: 680,027

[22] Filed: Apr. 26, 1976

[51] Int. Cl.[2] ..... C23F 1/02

[52] U.S. Cl. ..... 156/345; 137/391; 137/426; 156/627; 156/642

[58] Field of Search ..... 156/19, 345, 627, 642, 156/664; 222/319, 64; 137/391, 393, 426, 389, 386

[56] References Cited

U.S. PATENT DOCUMENTS

| | | | |
|---|---|---|---|
| 2,885,118 | 5/1959 | Remke | 137/391 |
| 2,959,055 | 11/1960 | True | 137/391 |
| 3,136,455 | 6/1964 | Coes | 222/319 |
| 3,186,598 | 6/1965 | Jonsson | 222/319 |
| 3,298,231 | 1/1967 | Zukley | 137/426 |
| 3,592,715 | 7/1971 | Lindstrom | 156/19 |
| 3,843,504 | 10/1974 | Nayder | 156/642 |
| 3,933,544 | 1/1976 | Haas | 156/642 |
| 3,964,956 | 6/1976 | Snyder | 156/345 |

*Primary Examiner*—Charles E. Van Horn
*Assistant Examiner*—Jerome W. Massie
*Attorney, Agent, or Firm*—Neil F. Martin; Edward B. Johnson

[57] ABSTRACT

The ORP of the initial etchant solution is utilized as a set point. A predetermined change in the ORP triggers the removal of a predetermined volume of spent etchant. Fresh etchant addition steps and oxidation of the working etchant (addition of chlorine) are sequenced by the initial fixed volume withdrawal. The oxidation and fresh etchant addition steps proceed to conclusion independently. The oxidation step is terminated by a return of the ORP to the initial level.

14 Claims, 3 Drawing Figures

ETCHANT REJUVENATION CONTROL SYSTEM

BACKGROUND OF THE INVENTION

Industrial etching processes are utilized on a large scale in mass production of components. The manufacture of printed circuit boards represents the largest single use of industrial etching processes. A thin layer of copper is applied to a substrate such as epoxy resin or other insulative material. The copper layer is selectively coated in a photographic process with protective etch resist. The copper not covered by the resist is then chemically removed by immersing the circuit board in, or spraying the circuit board with, a suitable etchant which chemically dissolves the exposed copper. Thereafter, the remaining resist pattern is removed by solvent to yield the desired conductive printed circuit pattern.

Heated ferric chloride is a commonly used etchant. Ferric chloride is relatively active for the etching operation and relatively safe for handling by operating personnel.

A solution of ferric chloride in water is sprayed or otherwise brought into contact with the surface of the copper to be etched. The ferric ($Fe^{+++}$) ions react with copper and are reduced to ferrous ($Fe^{++}$) ions whereas the copper ($Cu^0$) is converted into cuprous ($Cu^{+1}$) ions according to the following equation:

$$Fe^{+++} + Cu^0 \rightarrow Fe^{++} + Cu^+$$

As the cuprous ($Cu^+$) ion dissolves into solution, it immediately reacts with another ferric ion ($Fe^{+++}$) according to the following equation:

$$Fe^{+++} + Cu^+ \rightarrow Fe^{++} + Cu^{++}$$

Thus, as more copper is dissolved into the solution, the concentration of ferrous ions increases and the concentration of ferric ions decreases. The remaining ferric ion concentration is a principal factor in the effectiveness of the remaining etched solution. Other variables such as solution density and temperature also alter the effectiveness of the solution. Other industrial etchants, such as $CuCl_2$, $(NH_4)_2S_2O_7$, and ammoniated $ClO_2$ may be utilized. Similar considerations apply to the effectiveness of these solutions. As the etchant is reduced in the process of etching metal, the effectiveness of the solution decreases.

There are three principal techniques for maintaining a controlled etching process.

The simplest process and the one requiring the least additional equipment is a batch process. In a batch process, the etchant is utilized until the quantity of etched metal in solution renders the solution ineffective for further etching. The time required to etch a given thickness of metal from the workpieces passing through the etchant process varies with the amount of copper in solution. Applicant's previously filed application entitled "Etched Rate Monitor and Etching Control", Ser. No. 575,567, filed May 8, 1975, now abandoned, describes a system for use with a batch etching process whereby the instantaneous etch rate may be determined as a function of the ORP of the solution. The entire specification of this application is hereby incorporated into this application. In this previous application, the absolute value of the ORP (oxidation-reduction potential) is compared to the absolute value of the ORP in a reference solution having the same parameters as the initial concentration in the working etchant. Such a process has particular utility where production rates are highly variable. Since no peripheral equipment is required, there is no investment in equipment not being utilized during a hiatus in production. However, where the production is relatively continuous such a batch process has the disadvantage that as the solution becomes more nearly spent, the etch rate decreases and therefore, the production rate is reduced. For a given production requirement then, such a system must have excess capacity with fresh etchant in order to have adequate capacity with nearly spent etchant. Therefore, there is a need for an etching process that maintains a uniform etch rate.

The most complex process is generally referred to a regeneration. A regeneration process is capable of producing a uniform etch rate. The etched metal, such as copper, is continuously removed (by crystalization for example) and the reduced ion reoxidized to maintain maximum effectiveness for the etchant. Such processes require auxiliary regeneration equipment sufficient to remove etched metal from the solution as fast as it is built up during maximum production rates. Thus, production at anything less than the maximum rate results in inefficient use of the regeneration equipment. Further, such equipment is expensive to purchase initially and must be continuously maintained and calibrated to obtain satisfactorly results.

Rejuvenation is another process with the capability for maintaining a uniform etch rate. In rejuvenation, a portion of the working etchant is periodically removed and replaced by fresh etchant. The process of removing spent etchant results in the removal of some of the copper in solution. At the same time, an oxidation process may be utilized to increase the concentration of oxidized ions to the initial level. Such a process requires monitoring of the amount of etchant removed, the amount of etchant added and the amount and rate of oxidant addition for the reoxidation process. Various parameters are monitored by prior art devices for these purposes. The acidity of the solution is one indication of its state. Similarly, the opacity of the solution may be utilized as a rough indication of the oxidation state. The ORP of the solution may also be utilized to determine when it is necessary to begin the rejuvenation process. However, according to prior art techniques, the ORP must be utilized in comparison to a reference etchant, because of the highly dynamic nature of the ion concentration in industrial strength etchants. In the ferric chloride etchant complex, for example, there are ferric ions, cupric ions and ammonium complexes that produce a continuously varying dynamic solution with the resultant variations in the ORP. Comparison to a reference solution with the same initial parameters, reduces the effect of these variables. However, dependence on a reference solution requires that the fresh etchant added and spent etchant be removed in precise proportions and timed relation. Typically, metering pumps must be utilized so that the etchants removed by pumping and drag out will be precisely balanced in precise stoiciometric amounts by the etchant added. Etchant removal and addition must be carefully coordinated with reoxidation.

A system for employing the ORP in a process for rejuvenation of etchant is described in applicant's copending application, Ser. No. 517,665 filed Oct. 24, 1974, now U.S. Pat. No. 3,951,711 issued Apr. 20, 1976, for "System for Maintaining Uniform Copper Etching Efficiency". The entire disclosure of the aforesaid patent is incorporated by this reference. Such a process requires expensive and high maintenance metering pumps. If, for example, it is necessary to replace one of the metering pumps, the whole system must be shut down and preferably the entire solution replaced so that the ORP set point may be initialized on a new solution of fresh etchant. Also frequent recalibrations of the metering pumps and their flow in relation to the oxidant ($Cl_2$) is required.

Therefore, it is desirable to have an etchant rejuvenation control system for an etchant rejuvenation process that is not dependent upon the absolute value of any solution parameter and which does not require precise metering pumps or the like to coordinate the removal and addition of solution with the addition of oxidant. Such a control system is particularly desirable where it makes it possible for etchant removal, addition and oxidation steps to each proceed at their own optimum rate determined by system operational requirements rather than by a required coordination with the addition, removal and oxidation.

SUMMARY OF THE INVENTION

An exemplary embodiment of the invention is described in its utilization with a ferric chloride based etching solution. However, it is to be understood that the system is equally effective with other etching solutions so long as the effectiveness of the solution is related to a change in the ORP. The initial ORP of the solution is utilized as a set point for an ORP receiver. A predetermined deviation of the ORP from the initial set point commences a series of interlocked system functions. The interlocked control steps permit the individual rejuvenation operations to each proceed separately as determined by operating characteristics of the system. For example, the rate of solution withdrawal is determined by the operating characteristics of the pump. Since the pump operating characteristics are thereby no longer critical, it is possible to use inexpensive and highly dependable, efficient centrifugal pumps, rather than expensive and high maintenance metering pumps. It is also possible to substitute gravity flow for pumping (except for circulation pumps) and as used hereinafter the term "pump" shall include an equivalent gravity flow arrangement. Completion of the etchant withdrawal steps is determined by a volume measurements. similarily, the etchant addition step may proceed independently of the etchant withdrawal step and may proceed to completion at a rate determined by the operating characteristics of the associated pump. The rate of oxidant addition may be set to correspond to the optimum rate for the associated apparatus for exposing the etchant to the oxidant, and may be set at a sufficiently low rate that the chance of excess oxidant being released into the surrounding environment is minimized. Completion of the oxidation step is detected by a return to the nominal initial ORP, and may take place before or after the completion of the fresh etchant addition step. In fact, the only time limitation of completion of any of the independent steps is that they must on the average be completed prior to the next time that the ORP detects the sufficient variation from the norm to initiate another sequence of operations. The simplicity of the system does not compromise the ability of the system to maintain tight control over the etching efficiency of the solution and therefore, maintain a highly uniform etch rate.

In a complete installation, separate provision is made for maintaining the temperature and density of the solution. However, these devices form no part of this invention.

It is therefore an object of the invention to provide a new and improved etchant rejuvenation control system.

It is another object of the invention to provide a new and improved etchant rejuvenation control system that is not dependent on the absolute value of the etchant ORP.

It is another object of the invention to provide a new and improved etchant rejuvenation control system that detects a single solution parameter to control three process variables.

It is another object of the invention to provide a new and improved etchant rejuvenation control system that is not dependent on etchant addition or withdrawal flow rates.

It is another object of the invention to provide a new and improved etchant rejuvenation control system that is not dependent upon oxidant addition flow rates.

It is another object of the invention to provide a new and improved etchant rejuvenation control system that is relatively low in cost.

It is another object of the invention to provide a new and improved etchant rejuvenation control system that requires minimal in-service maintenance.

Other objects and many attendant advantages of the invention will become more apparent upon a reading of the following detailed description together with the drawings, in which like reference numerals refer to like parts throughout and in which.

DETAILED DESCRIPTION OF THE DRAWINGS

Figure 1:
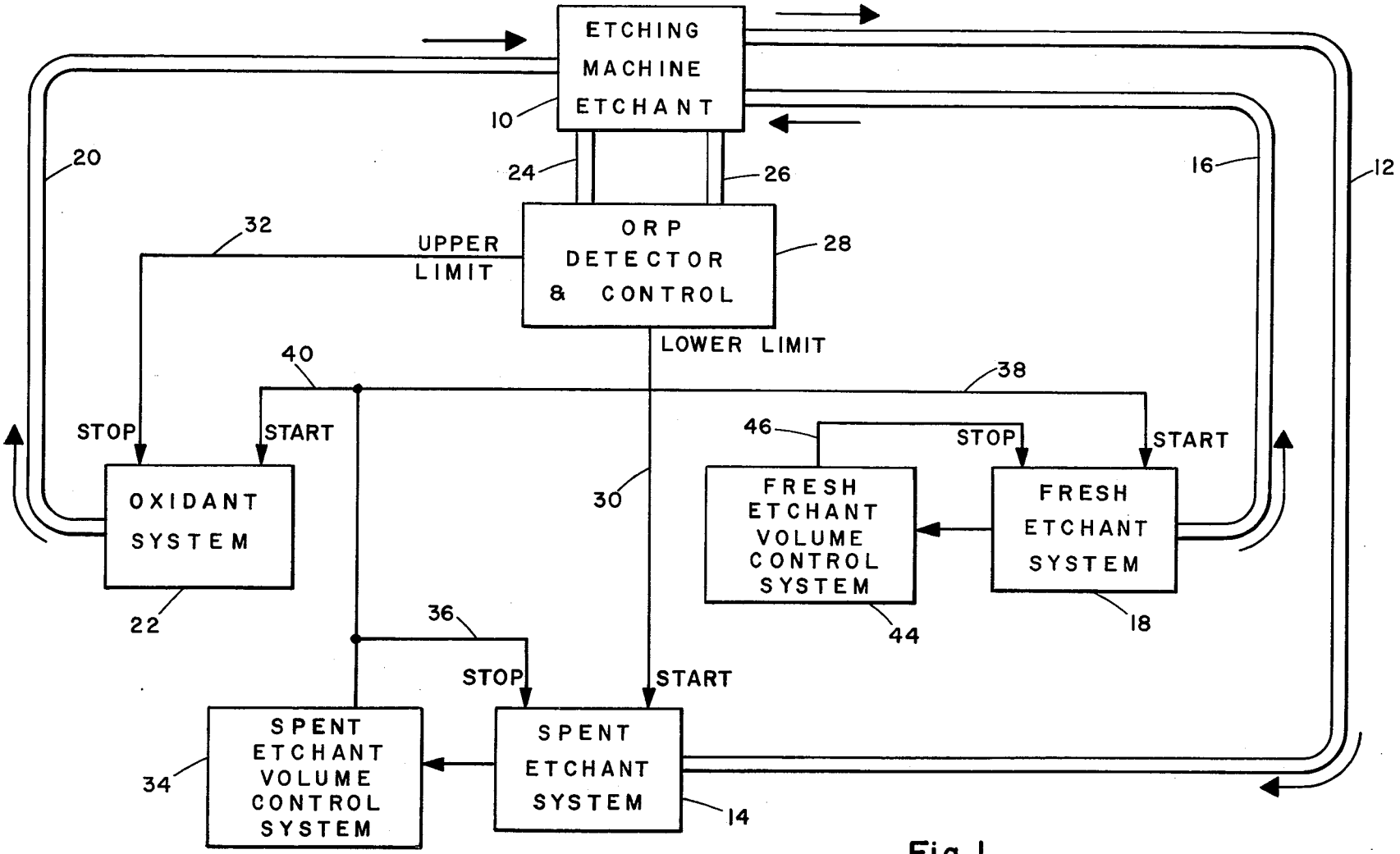
FIG. 1 is a schematic representation of the principal system components.

Referring now to the drawings, in FIG. 1 there is illustrated the principal system components. An etching machine 10 is connected by piping 12 to a spent etchant system 14 for withdrawing etchant from the etchant machine or its circulating system. Piping 16 connects the etching machine 10 to a fresh etchant system 18 for adding replacement etchant. Piping 20 connects the etching machine 10 to an oxidation system 22 for reoxidizing the active components of the solution to restore etching vigor. Piping 24 and 26 circulates working etchant from etching machine 10 through an ORP detector and control system 28. The ORP detector and control 28 has a first output on line 30 for signalling commencement of a rejuvenation cycle. A second output on line 32 terminates the oxidation of the etchant.

It is within the scope of the invention for the signal on line 30 to start all of the three independent rejuvenation steps simultaneously. However, it has been found to be operationally superior for the start of the oxidation and spent etchant systems to await completion of the spent etchant withdrawal. Accordingly, the signal from line 30 cuases the spent etchant system 14 to begin withdrawing spent etchant. When a preset volume of spent etchant is withdrawn, the spent etchant volume control system signals the spent etchant system on line 36 to discontinue withdrawal of spent etchant. The same signal that discontinues the withdrawal of spent etchant commands the addition of fresh etchant on line 38 and simultaneously commands the operation of the oxidant system 22 on line 40. The operation of the fresh etchant system 18 is monitored by the fresh etchant volume control system 44. The control system 44 allows the fresh etchant system to add fresh etchant with a volume that corresponds to the volume of spent etchant plus the estimated drag out by parts passing through the etching machine 10. When the required volume is reached, a signal on line 46 shuts off the addition of fresh etchant. The oxidant system 22 which commences operation simultaneously with the fresh etchant system, continues to completion independently of the fresh etchant system 18. The flow of oxidant into the working etchant is controlled in accordance with the optimum flow rate to obtain reoxidation of the etchant without evolving excess gaseous oxidant. When the ORP detector and control 28 detects that the ORP has returned to the initial level, it shuts off the oxidant system 22.

Figure 2:
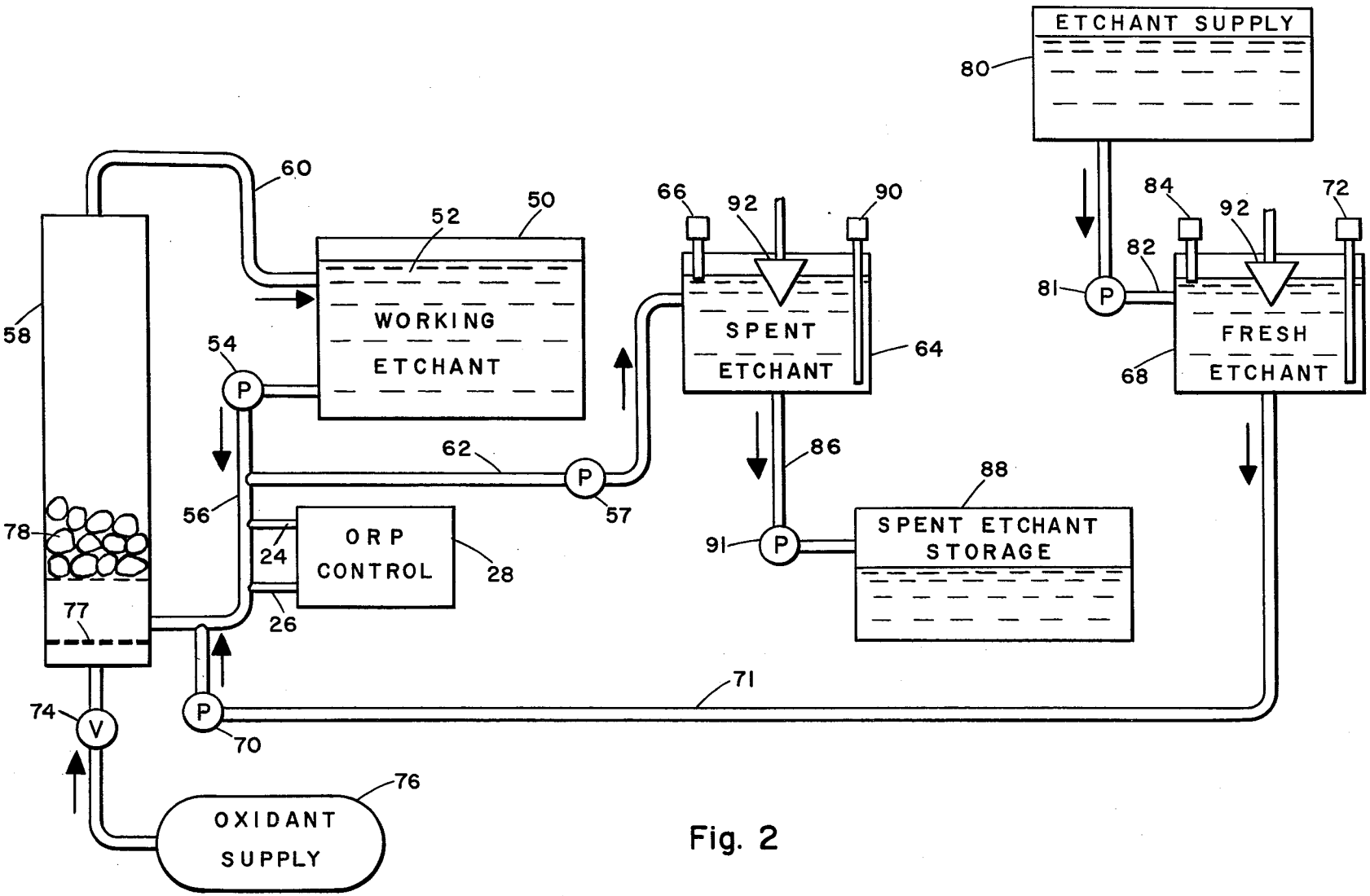
FIG. 2 is an illustration of the non-electrical components.

FIG. 2 illustrates the form of the principal non-electrical components of the system and sufficient piping and pumps to relate the components to the overall system. An etching tank 50 contains a quantity of working etchant 52. A pump 54 provides a continuous circulation of working etchant in a circulating system comprising the pipe 56, mixing tower 58 (or a sufficient length of downstream piping to assure complete reaction of the oxidant with the working solution before the solution re-enters the etching machine), and return pipe 60. The ORP detector and control 28 continuously monitors the ORP of the etchant circulating in the recirculation system. When a preset change in the ORP is detected, a pump 57 begins to withdraw spent etchant from the pipe 56. The spent etchant is pumped via pipe 62 to the spent etchant volume tank 64. Removal of spent etchant continues until the preset volume is reached as detected by a level control 66. As noted above, the completion of the preset volume withdrawal may be utilized to initiate the addition of fresh etchant. A preset volume of fresh etchant has previously been stored in the fresh etchant volume tank 68. A pump 70 withdraws fresh etchant from tank 68 through pipe 71 and supplies it to pipe 56, until a signal from the level control 72 discontinues its operation.

The signal from level control 66 is also utilized to open the valve 74 and to cause oxidant (chloride from tank 76) to be delivered to the mixing tower 58. The chlorine gas passes through a separator 77 and through loose packing 78 where it is thoroughly mixed with and dissolved in the working etchant circulating through the mixing tower 58. The completion of the oxidation step is signalled by the ORP detector and control 28 as will be described more fully hereinafter. The completion of the fresh etchant addition also initiates the step of admitting replacement fresh etchant into the volume tank 68. The replacement fresh etchant is delivered from a storage tank 80 by pump 81 through pipe 82 until the level of fresh etchant in tank 68 reaches that level preset into level control 84. A similar operation commences in the spent etchant volume tank 64 after the required volume of spent etchant is removed from the etching system. Spent etchant is discharged through pipe 86 into storage tank 88 by a pump 91. The discharge continues until the level of spent etchant in tank 64 reaches that level detected by the level control 90 whereupon the pump 91 is shut down. The volume of liquid between the upper and lower limits is normally set by an adjustment of the various level control devices. Fine adjustment of each volume is accomplished by a conical volume adjustor 92. The volume adjustor 92 is inserted into the etchant in tanks 64 and 68, a sufficient distance to reduce the volume of etchant required to operate the upper liquid control. In this manner, the precise relationship between the spent and fresh etchant may be adjusted during actual machine operation.

Figure 3:
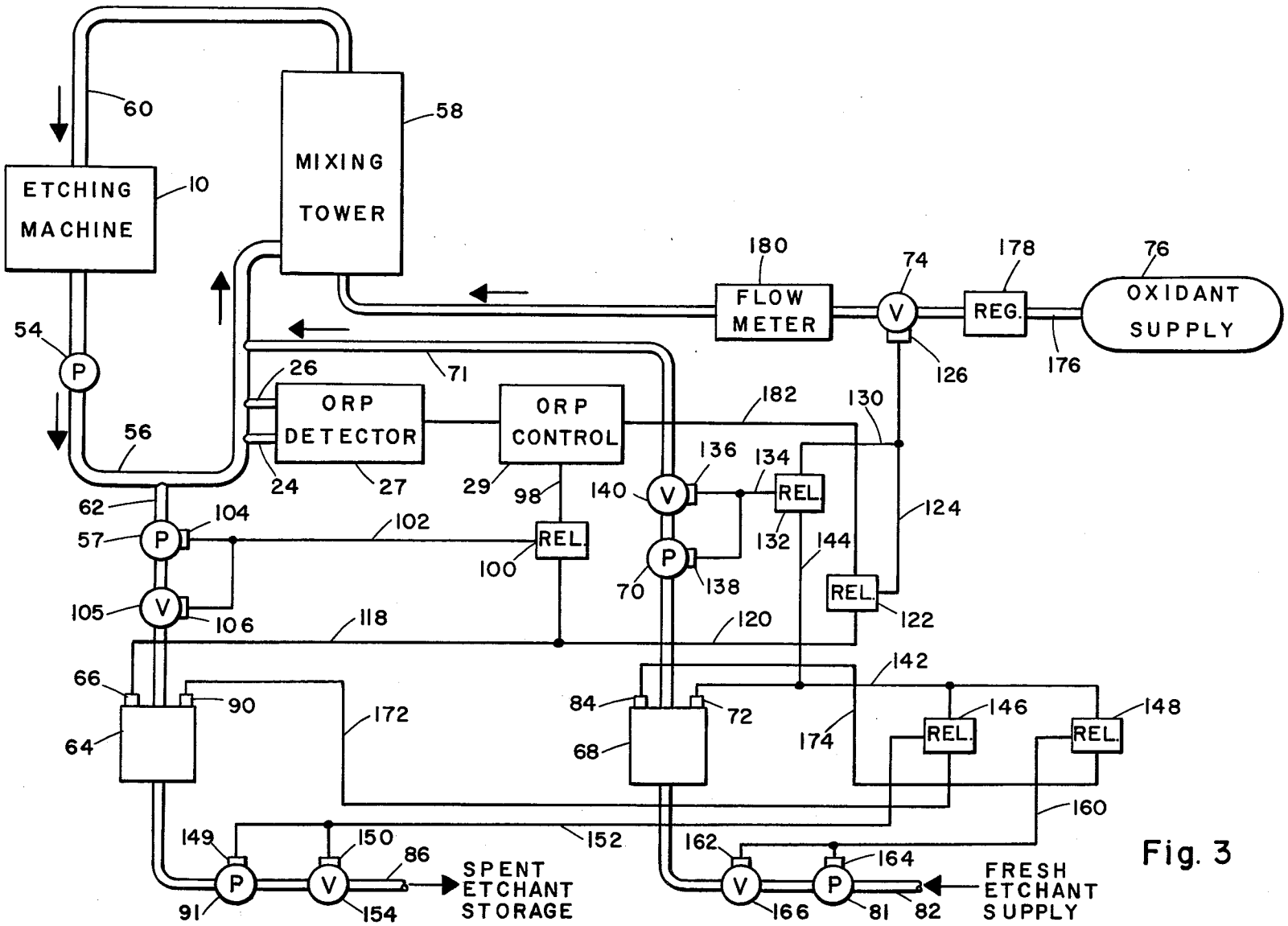
FIG. 3 is a schematic diagram of the complete hydraulic and electrical system.

Referring now to FIG. 3, there is illustrated a schematic representation of the complete control system according to the invention. Working etchant is continuously circulated from the etch machine 10 by pump 54. All of the system operations including etchant withdrawal, addition, ORP detection, and oxidation are desirably accomplished in the circulating system. The circulating system pipe 56 circulates working etchant past the spent etchant removal pipe 62, the ORP detector supply and return pipes 24 and 26, the fresh etchant addition pipe 71 and into the mixing tower 58. Pipe 60 returns the working etchant to the etch machine 10. The ORP detector 27 may be any suitable detector for detecting changes from an initial ORP. The absolute value of the ORP need not be determined. A suitable ORP detector is described in applicant's co-pending application, Ser. No. 517,665, now U.S. Pat. No. 3,951,711 issued Apr. 20, 1976. The ORP control 29 monitors the signals from the ORP detector 27. A suitable ORP control 29 may incorporate a voltage sensitive relay capable of detecting a preset deviation in voltage and produce an output in response to such a predetermined voltage change.

A second voltage sensitive relay set by the first is responsive to a return to the initial set point and upon return of the voltage level to the original set point, it produces a second signal. The first signal, corresponds to a voltage deviation caused by the working etchant reaching a predetermined level of depletion, is transmitted on the line 98 to the latching input of latching relay 100. Latching of relay 100 produces a signal on line 102 to solenoids 104 and 106. Solenoids 104 and 106 provide power to pump 57 and actuate valve 105 so that working etchant is withdrawn from the circulating system and discharged into volume measuring tank 64. When the predetermined volume of spent etchant is removed, the liquid level in volume tank 64 will reach a level at which the level control 66 is energized. The output of level control 66 on line 118 is connected to the unlatching connection of relay 100 thereby removing power from the solenoids 104 and 106 and discontinuing the filling operation of the spent etchant volume tank 64. The signal on line 118 is also connected by line 120 to the latching side of latching relay 122. Thus, filling of the spent volume tank triggers a signal on line 124 of relay 122 and operates a solenoid 126 to open valve 74. Opening of valve 74 permits chlorine to flow from tank 76 into the mixing tower 58, as will be described more fully hereinafter.

The signal on line 124 is also delivered by line 130 to the latching side of relay 132. The output of relay 132 on line 134 energizes solenoids 136 and 138. The solenoids open the valve 140 and activate pump 70 to deliver fresh etchant from the fresh etchant volume tank 68 to the working etchant recirculating system through pipe 71. When the proper volume offresh etchant has been pumped out of tank 68, the level therein will correspond to that detected by the level control 72 which thereupon produces a signal on line 142. The signal on line 142 is delivered by line 144 to the unlatching side of relay 132 to cause the pump 70 to shut off and valve 140 to close. Emptying of tank 68 as signalled on line 42 also activates relays 146 and 148. Relay 146 energizes solenoids 149 and 150 on line 152 and thereby opens solenoid operated valve 154 and turns on pump 91 to discharge the spent etchant to storage through pipe 86. At the same time, relay 148 produces an output on line 160 energizing solenoids 162 and 164 to open valve 166 and turn on pump 81, to refill the fresh etchant volume tank 68 with etchant from fresh etchant storage through pipe 82. In tank 64, the lower limit liquid control 90 determined when the tank has been emptied. The liquid control 90 produces a signal on line 172 to unlatch relay 146 and thereby to discontinue pumping of spent etchant to storage. Similarily, the new volume offresh etchant is detected by the upper limit liquid control 84 in tank 68. The liquid control 84 produces a signal on line 174 to unlatch relay 148 and discontinues the pumping of fresh etchant into the fresh etchant volume tank 68. It should be noted that the filling and emptying of both tanks 64 and 68 is allowed to proceed to completion at a rate determined by the operating characteristics of the associated pumps and valves and is not determined by any other system function or timing.

The oxidant system begins operation after a signal from the liquid control 66 indicating that a predetermined volume of spent etchant has been withdrawn from the circulating system. Thereafter, relay 122 isolates the oxidant system from the etchant withdrawal and addition systems. Further control of the oxidant system is determined by the ORP control 29. The signal on line 124 opens valve 74 to cause chlorine gas from tank 76 to be delivered under pressure through pipe 176 through a regulator 178. A flow meter 180 is utilized to set the regulator 178 to obtain a rate of flow within the mixing capabilities of mixing tower 58. Since the oxidation process is independent from the etchant withdrawal and addition steps, the rate of flow may be set to proceed at the safe rate well below the system capabilities so that excess chlorine is never introduced into the etch machine and thereby the danger of chlorine gas being emitted from the etch machine is minimized. The addition of chlorine has the effect of converting ferrous ions back into ferric ions and thereby rejuvenates and returns the etching vigor of the etching solution. As additional chlorine is mixed into the working etchant, the ORP of the solution begins to return to the initial level. ORP control 29 will produce an output on line 182 when the initial level is attained. Line 182 is connected to the unlatching side of relay 122 and thereby interrupts the power of solenoid 126 and stops the flow of chlorine gas through valve 74. Thus, the flow of the oxidizing chlorine gas is determined by a return to the etchant to its original vigor. This both assures continued etching effectiveness and also insures that excess chlorine gas will never be introduced into the system since the ORP of the solution will always return to the initial level upon an appropriate level of oxidation.

Having described my invention, I now claim:

1. An etchant rejuvenation control system for use in an etching machine having a quantity of working etchant for etching metal from a workpiece comprising:

means for detecting a variation of the ORP of a working etchant, means for withdrawing a predetermined volume of etchant upon a predetermined change in said detected ORP, means for sensing completion of the withdrawing of etchant, means responsive to said withdrawing of etchant for initiating the injection into the working etchant of an oxidizer at a predetermined flow rate, means for terminating the injection of said oxidizer when said detected ORP returns to the initial level, means responsive to the withdrawal of etchant for adding fresh etchant, means for terminating the addition of fresh etchant after a predetermined volume has been added.

2. The system according to claim 1 wherein:

said means for withdrawing a predetermined volume of etchant comprises a spent etchant volume tank having at least one spent etchant level control for producing a signal when a predetermined level of withdrawn etchant is obtained.

3. The system according to claim 2 wherein:

said signal from said spent etchant level control is connected to said means for adding oxidant.

4. The system according to claim 3 wherein:

said signal from said spent etchant level control is connected to said means for adding fresh etchant.

5. The system according to claim 2 wherein:

a second spent etchant level control for producing a signal upon the level of withdrawn etchant reaching a level below said first level, means for discharging etchant from said tank under the control of said second spent etchant level control.

6. The system according to claim 1 wherein:

said means for adding fresh etchant comprises a fresh etchant volume tank, a source of fresh etchant connected to said fresh etchant volume tank, means responsive to the withdrawal of etchant for discharging etchant from said fresh etchant tank into said etch machine.

7. The system according to claim 6 wherein:

said fresh etchant volume tank includes a first fresh etchant level control connected to said means for adding fresh etchant for discontinuing the operation of said means for adding fresh etchant upon the liquid level in said volume tank being reduced to the level detected by said first fresh etchant level control.

8. The system according to claim 7 further including:

means for replenishing fresh etchant into said fresh etchant volume tank comprising a second fresh etchant level control in said etchant tank for detecting a level of etchant above the level detected by said first fresh etchant level control, said second fresh etchant level control controlling means for adding fresh etchant to said fresh etchant volume tank.

9. The system according to claim 5 further including:

means for adjusting the volume of etchant required to trigger said spent etchant level control.

10. The system according to claim 9 wherein:

said means for adjusting the volume of etchant comprises a conical member mounted for vertical movement in and out of said spent etchant volume tank.

11. The system according to claim 1 wherein:

said means for adding oxidant comprises a source of oxidant gas under pressure, a valve means responsive to a signal from said means for withdrawing etchant for permitting said oxidant gas to flow into said etching machine and responsive to an output of said means for detecting the ORP of the working etchant for discontinuing the flow of oxidant gas.

12. The system according to claim 11 further including:

a mixing tower, a circulating system for circulating working etchant from said etching machine through said mixing tower, said means for adding oxidant is connected to said mixing tower.

13. The system according to claim 8, further including:

means for adjusting the volume of etchant required to trigger said second fresh etchant level control.

14. The system according to claim 13 wherein:

said means for adjusting the volume of etchant comprises a conical member mounted for vertical movement in and out of said fresh etchant volume tank.

* * * * *